US012757959B2

(12) United States Patent
Donato

(10) Patent No.: US 12,757,959 B2
(45) Date of Patent: Oct. 13, 2026

(54) MODULAR VISION SYSTEM, PARTICULARLY FOR HELMETS AND THE LIKE

(71) Applicant: IFALCON S.R.L., Milan (IT)

(72) Inventor: Giuseppe Donato, Basiglio (IT)

(73) Assignee: IFALCON S.R.L., Milan (IT)

( * ) Notice: Subject to any disclaimer, the term of this patent is extended or adjusted under 35 U.S.C. 154(b) by 0 days.

(21) Appl. No.: 18/039,358

(22) PCT Filed: May 12, 2021

(86) PCT No.: PCT/EP2021/062640
§ 371 (c)(1),
(2) Date: May 30, 2023

(87) PCT Pub. No.: WO2022/111862
PCT Pub. Date: Jun. 2, 2022

(65) Prior Publication Data

US 2024/0000179 A1 Jan. 4, 2024

(30) Foreign Application Priority Data

Nov. 30, 2020 (IT) ..... 102020000028895

(51) Int. Cl.
*A42B 3/04* (2006.01)

(52) U.S. Cl.
CPC ..... *A42B 3/042* (2013.01)

(58) Field of Classification Search
CPC ..... A42B 3/042; A42B 3/04; A42B 3/228
See application file for complete search history.

(56) References Cited

U.S. PATENT DOCUMENTS 2,798,221 A * 7/1957 Bailey ..... A42B 3/228 2/10
3,748,657 A * 7/1973 Aileo ..... A42B 3/226 2/6.4
5,265,276 A * 11/1993 Kimberly, Jr. ..... A42B 3/042 2/6.2
7,219,370 B1 * 5/2007 Teetzel ..... F41G 1/30 2/6.2

(Continued)

FOREIGN PATENT DOCUMENTS

CN 106455735 A 2/2017
CN 207720301 U * 8/2018

(Continued)

OTHER PUBLICATIONS

Italian Search Report and Written Opinion dated Aug. 6, 2021 issued in IT 202000028895, with partial translation.

(Continued)

*Primary Examiner* — Tajash D Patel
(74) *Attorney, Agent, or Firm* — SCULLY, SCOTT, MURPHY & PRESSER PC

(57) ABSTRACT

A modular vision system, particularly for helmets and the like, which comprises a central portion adapted to support a video camera, a rear portion adapted to be coupled to a first end of the central portion and to support an electronic unit, and a front portion) adapted to be coupled to a second end of the central portion, the central portion and the rear portion being configured to conform to a profile of a shell of a helmet.

11 Claims, 10 Drawing Sheets

(56) References Cited

U.S. PATENT DOCUMENTS

| | | | | |
|---|---|---|---|---|
| 8,225,431 | B2 * | 7/2012 | Cyr | A42B 3/22 2/6.3 |
| 9,775,397 | B2 * | 10/2017 | Daniels | A42B 3/225 |
| 2002/0120979 | A1 * | 9/2002 | Prendergast | G02B 23/125 2/6.6 |
| 2006/0048286 | A1 | 3/2006 | Donato | |
| 2006/0072007 | A1 | 4/2006 | Gilor | |
| 2008/0170838 | A1 | 7/2008 | Corp. | |
| 2008/0263752 | A1 | 10/2008 | Insight | |
| 2017/0078622 | A1 | 3/2017 | Donato | |
| 2018/0164849 | A1 | 6/2018 | Chan | |
| 2023/0138236 | A1 * | 5/2023 | Sarlin | A42B 3/18 |
| 2024/0156201 | A1 * | 5/2024 | Teetzel | A42B 3/042 |
| 2024/0164464 | A1 * | 5/2024 | Teetzel | A42B 3/0406 |
| 2024/0349837 | A1 * | 10/2024 | Teetzel | A42B 3/30 |

FOREIGN PATENT DOCUMENTS

| | | | | |
|---|---|---|---|---|
| CN | 208354713 | U | 1/2019 | |
| WO | WO-9507489 | A1 * | 3/1995 | G02B 23/125 |
| WO | WO-9965059 | A1 * | 12/1999 | H01J 61/56 |
| WO | WO-2006065805 | A2 * | 6/2006 | G02B 23/125 |

OTHER PUBLICATIONS

International Search Report dated Aug. 24, 2021 issued in PCT/EP2021/062640.

Chinese Office Action dated Mar. 7, 2026 received in Chinese Application No. 202180080121.X, together with an English-language translation.

* cited by examiner

MODULAR VISION SYSTEM, PARTICULARLY FOR HELMETS AND THE LIKE

The present invention relates to a modular vision system, particularly for helmets and the like. More specifically, the invention relates to a modular vision system to be coupled to helmets that have different shapes.

As is known, vision systems exist which are adapted to be applied to helmets for special uses, such as for example the forces of law and order, fire fighters, and in all situations where it is necessary for an operator to wear a helmet for their safety and for the helmet to be pairable with a vision system that makes it possible to show the operator, directly on a display that can be arranged in front of the eyes of the operator, what is happening in front of the operator, as well as to transmit the images recorded by the vision system.

The vision system must be light in order to prevent difficulty in using the helmet, given that, after being worn for lengthy periods, a heavy helmet transmits excessive stresses to the neck of the operator, and therefore greatly limits the duration of time for which it can be used.

The adaptability of conventional vision systems is limited to a specially-designed helmet.

In substance, the vision system is customized to the outer shape of each helmet, and therefore it is not feasible to substitute the helmet with another of different shape, and keep using the vision system that was used previously with the substituted helmet.

This translates into the impossibility of standardizing a vision system that is adaptable to different shapes of helmet, not only because the shape of the shell of the helmet differs from helmet to helmet, but also because the shapes of the helmets themselves can differ even if they are used for the same type of use.

The aim of the present invention is to provide a modular vision system, particularly for helmets and the like, that is adaptable to any shape of helmet, without needing to substitute the entire vision system.

Within this aim, an object of the present invention is to provide a modular vision system that can be adapted with simplicity and rapidity to any shape of helmet without needing to substitute the electronic parts of the vision system itself, i.e., the unit for transmission/reception of the signals, and the video camera.

Another object of the present invention is to provide a modular vision system, particularly for helmets and the like, that makes it possible to modify the tilt angle of the video camera without needing to substitute the modular system itself.

Another object of the present invention is to provide a modular vision system, particularly for helmets and the like, that is simple to install by the operator, and can be substituted directly in the field.

Another object of the present invention is to provide a modular vision system, particularly for helmets and the like, that is highly reliable, easily implemented and low-cost.

This aim and these and other objects which will become more apparent hereinafter are achieved by a modular vision system, particularly for helmets and the like, characterized in that it comprises a central portion adapted to support a video camera, a rear portion adapted to be coupled to a first end of the central portion and to support an electronic unit, and a front portion adapted to be coupled to a second end of said central portion, said central portion and said rear portion being configured to conform to the profile of a shell of a helmet.

Further characteristics and advantages of the invention will become more apparent from the description of preferred, but not exclusive, embodiments of the modular vision system according to the present invention, which are illustrated by way of non-limiting example in the accompanying drawings, wherein.

Figure 1:
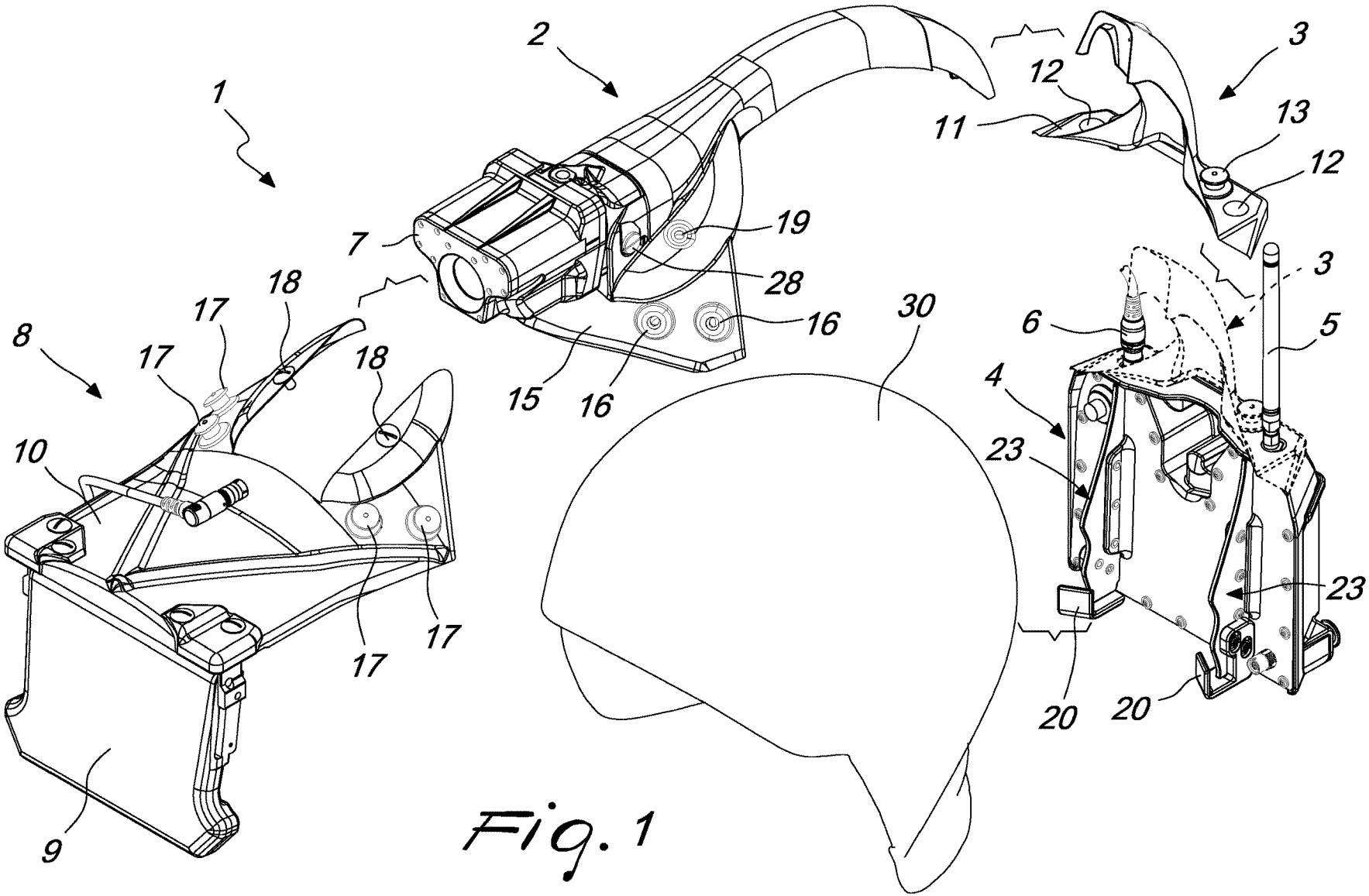
FIG. 1 is an exploded perspective view of the vision system according to the present invention.
Figure 2:
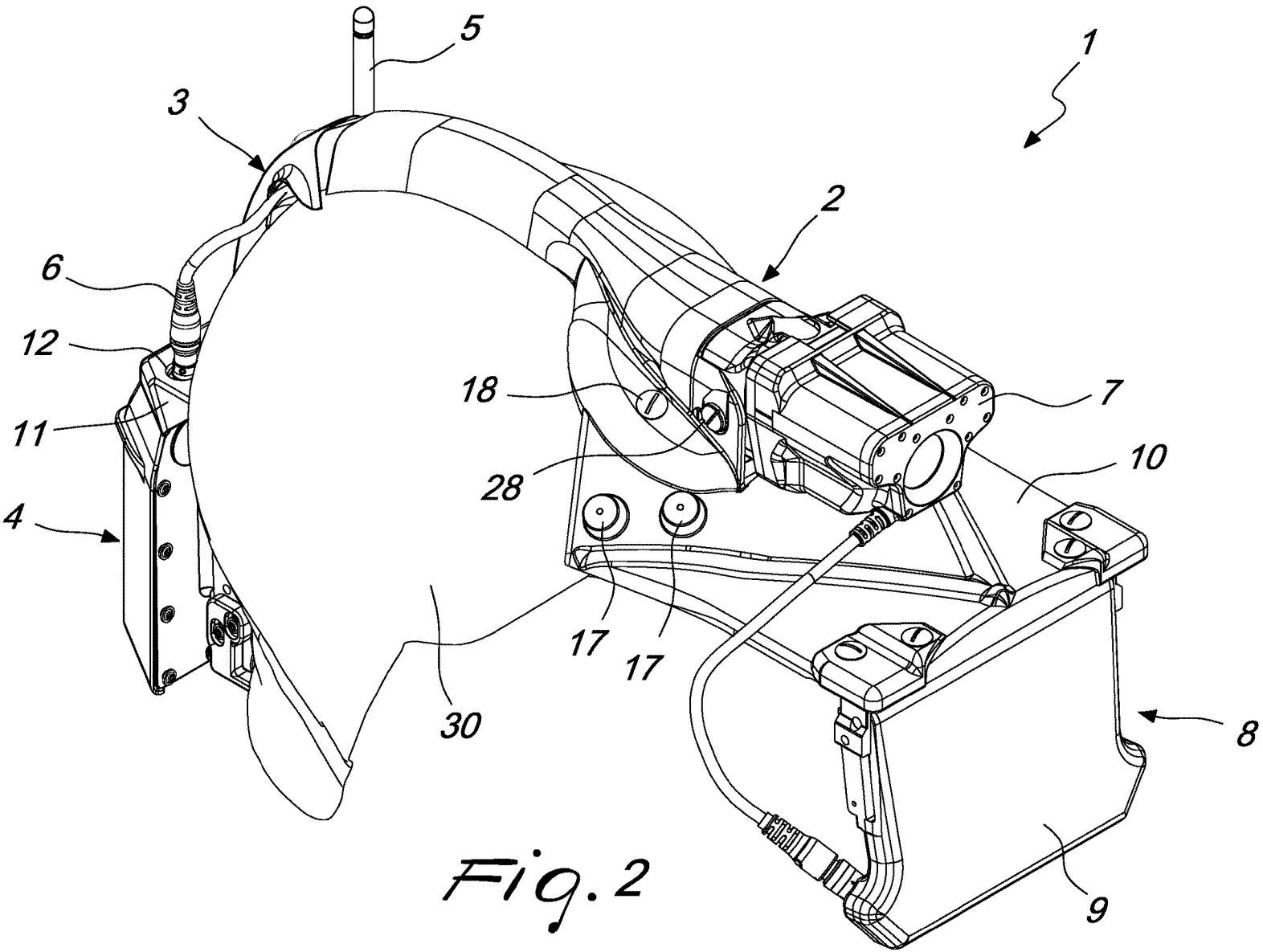
FIG. 2 is a perspective view from the front of the vision system according to the present invention, mounted on a helmet.
Figure 3:
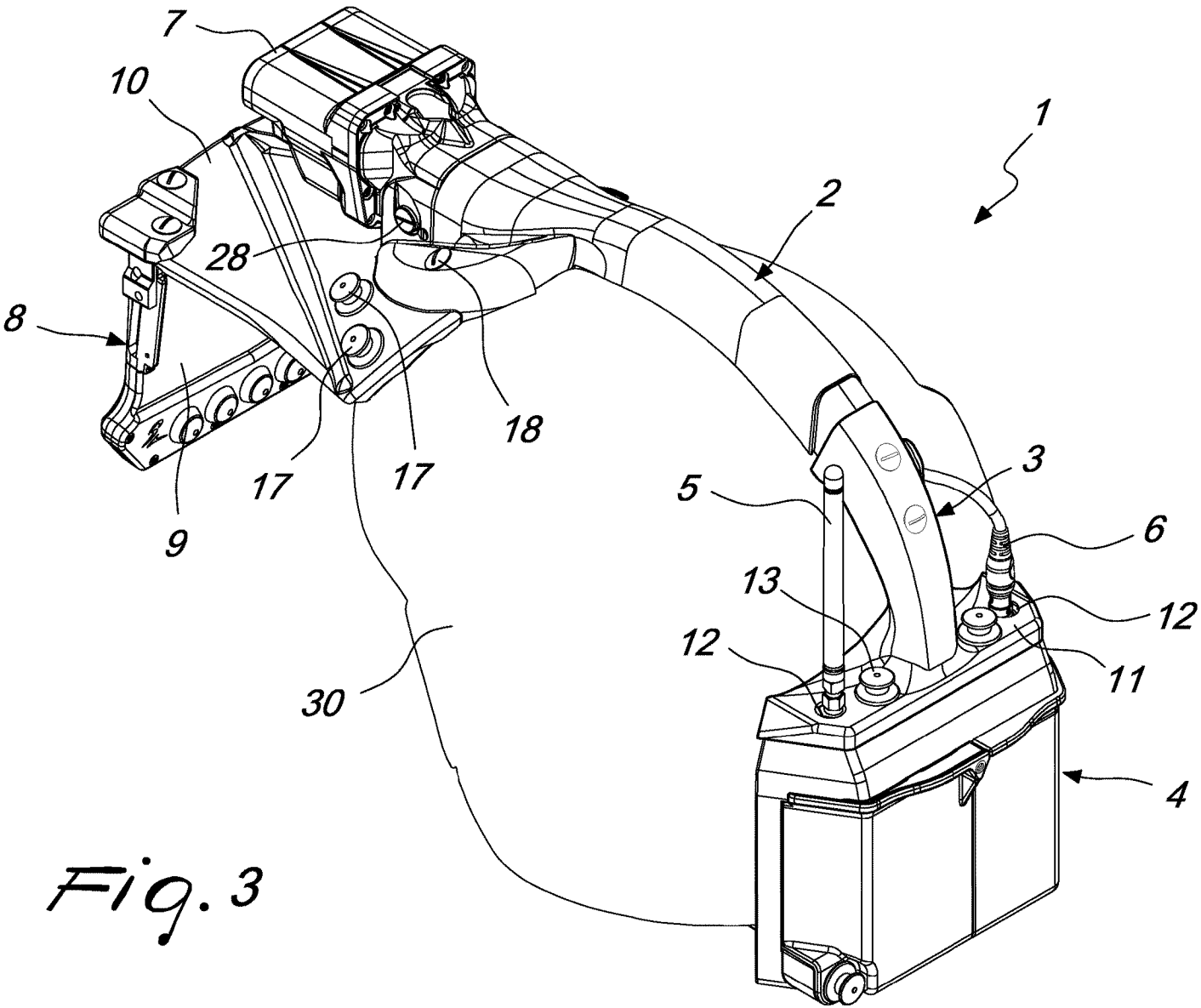
FIG. 3 is a perspective view from the rear of the vision system according to the present invention, mounted on a helmet.
Figure 4:
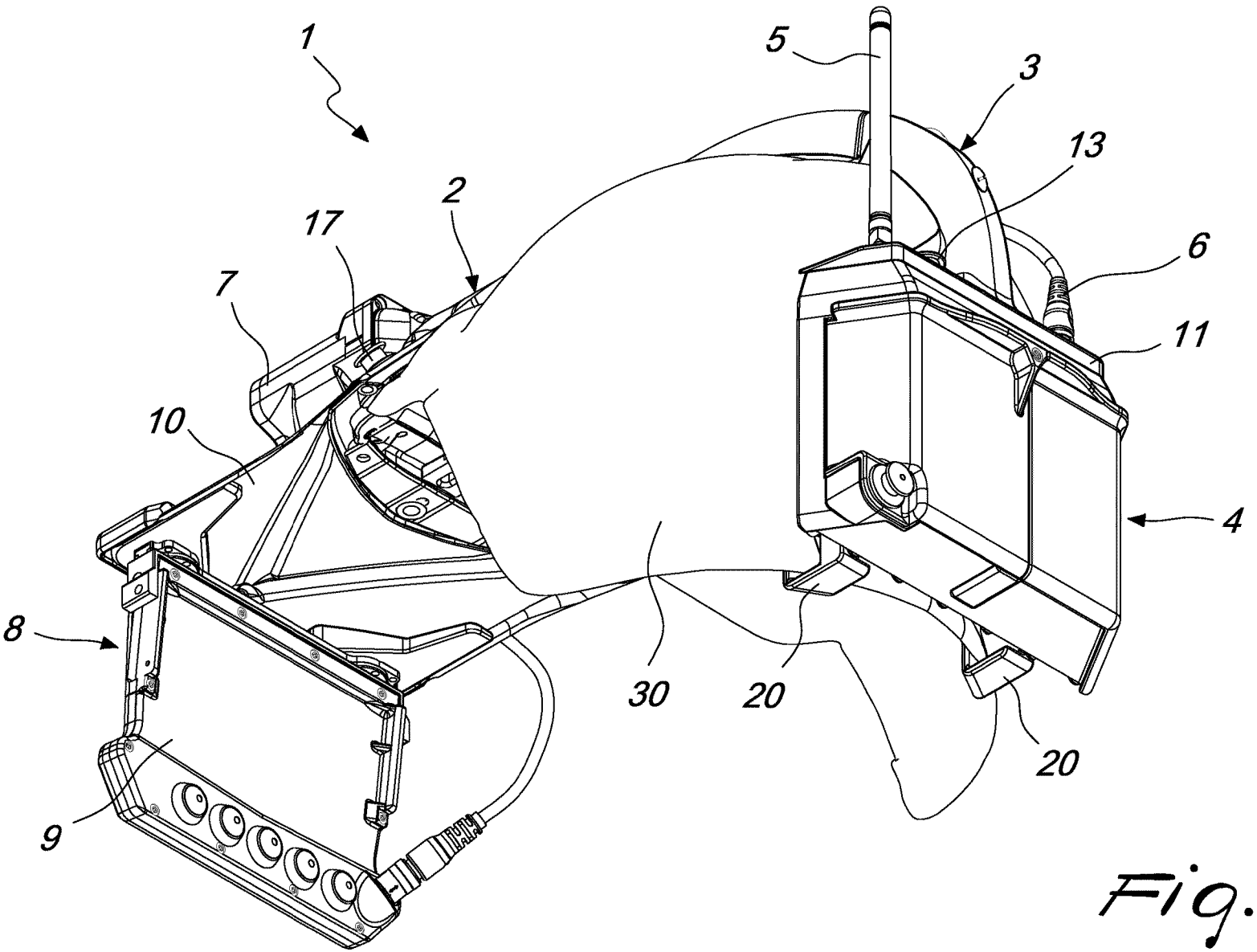
FIG. 4 is an additional perspective view of the vision system according to the present invention.
Figure 5:
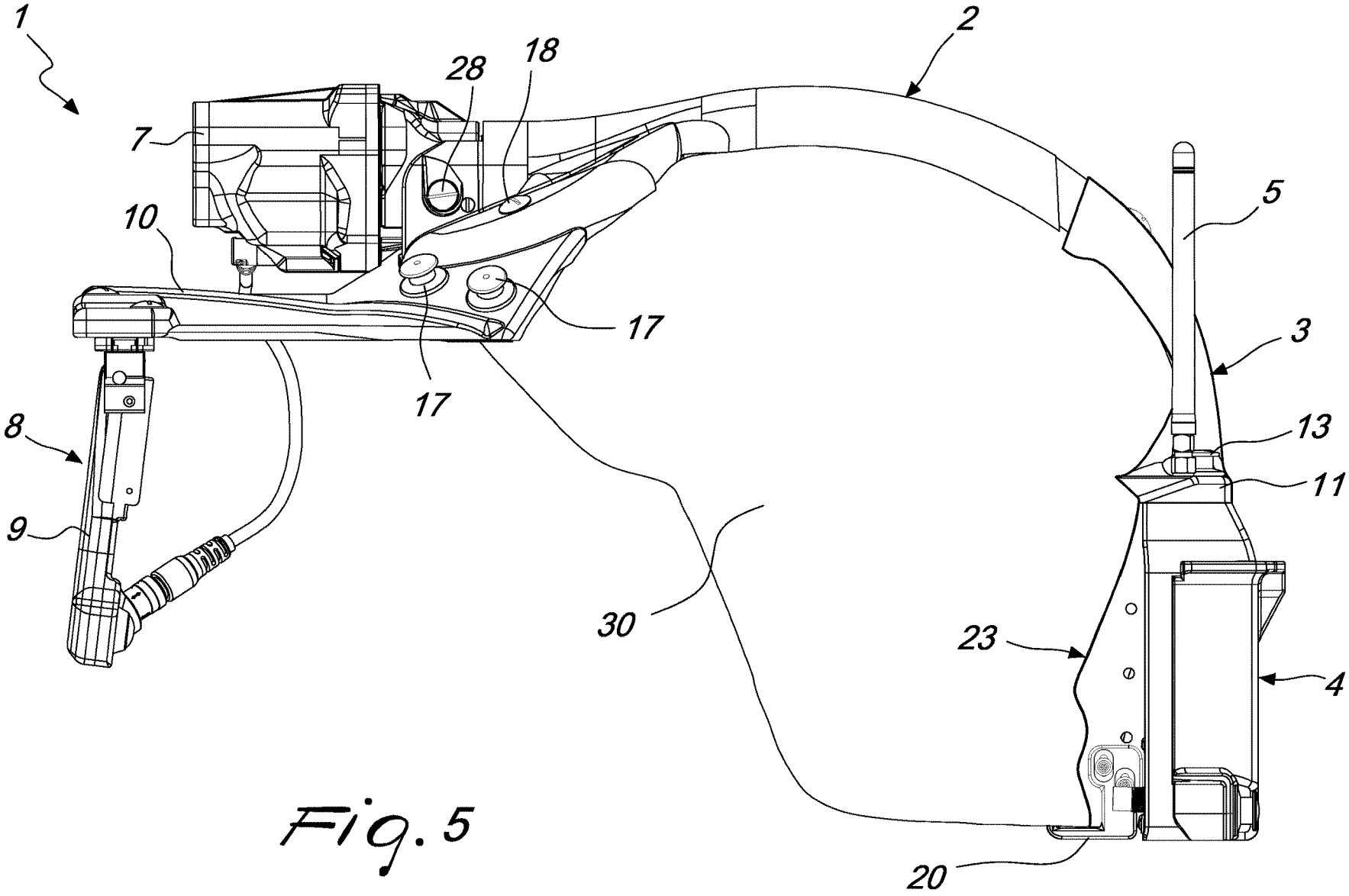
FIG. 5 is a side view of the vision system according to the present invention.
Figure 6:
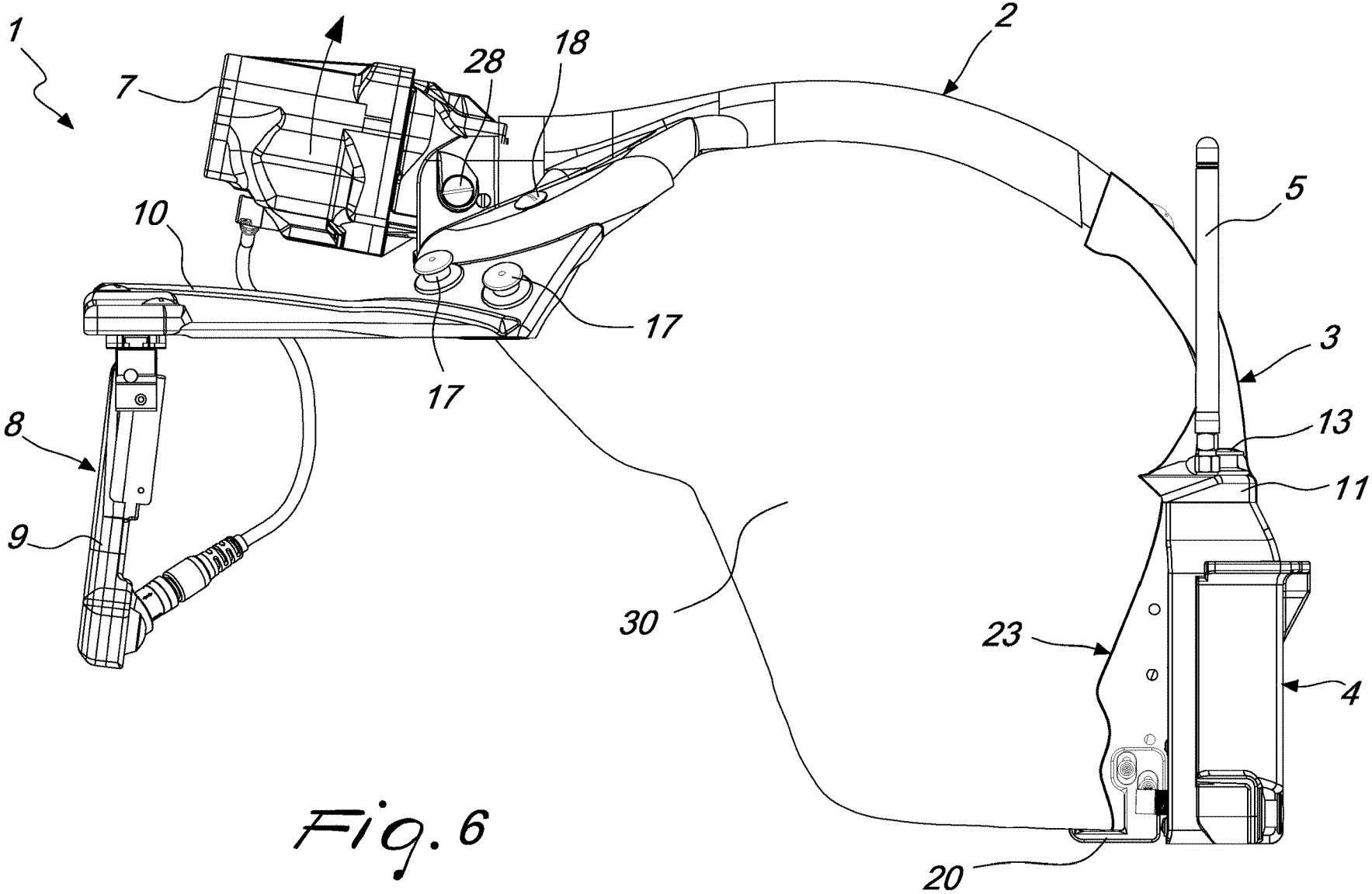
FIG. 6 is a side view of the vision system according to the present invention, with the video camera in the upward-tilted position.
Figure 7:
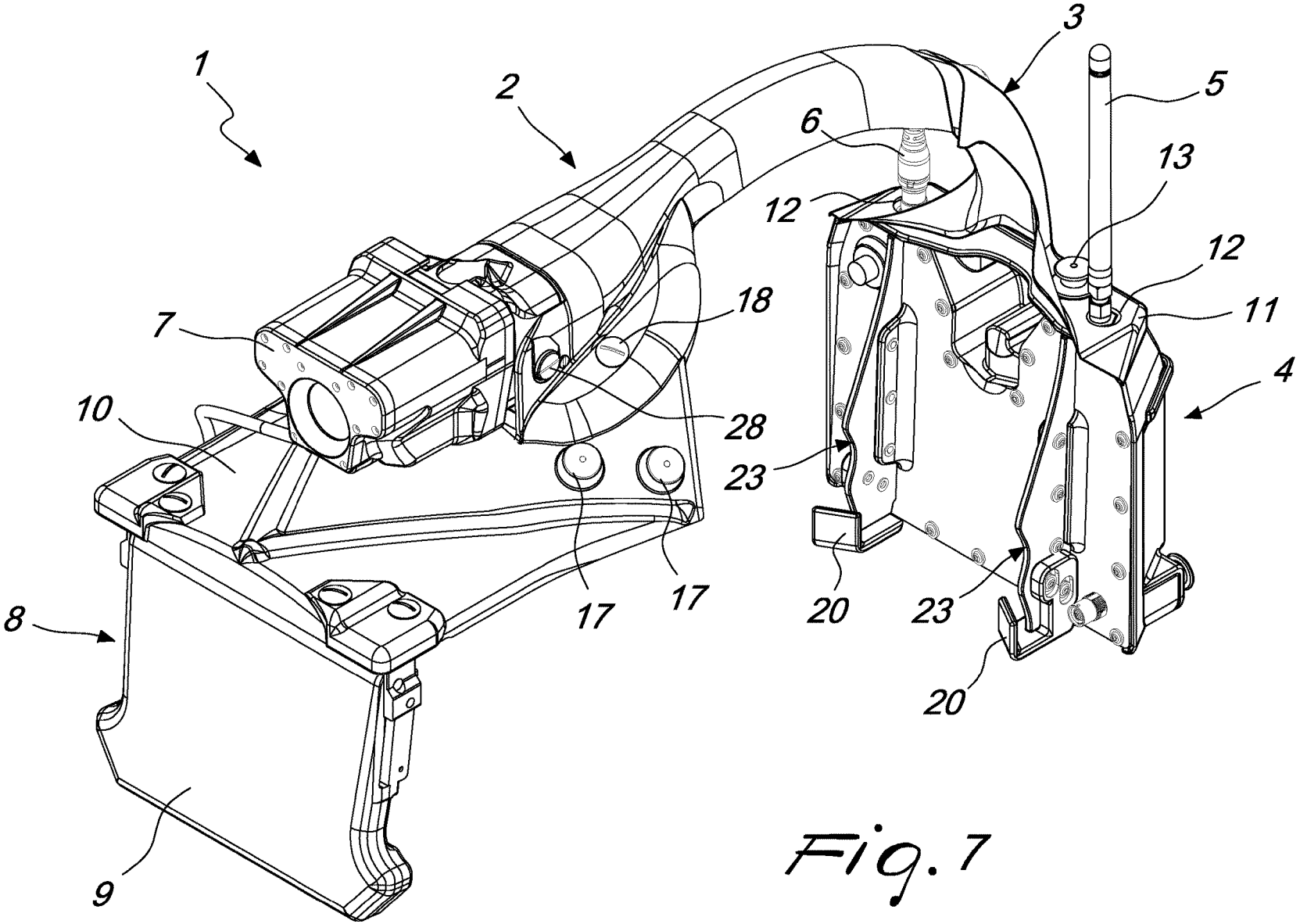
FIG. 7 is an additional perspective view of the vision system according to the present invention.
Figure 8:
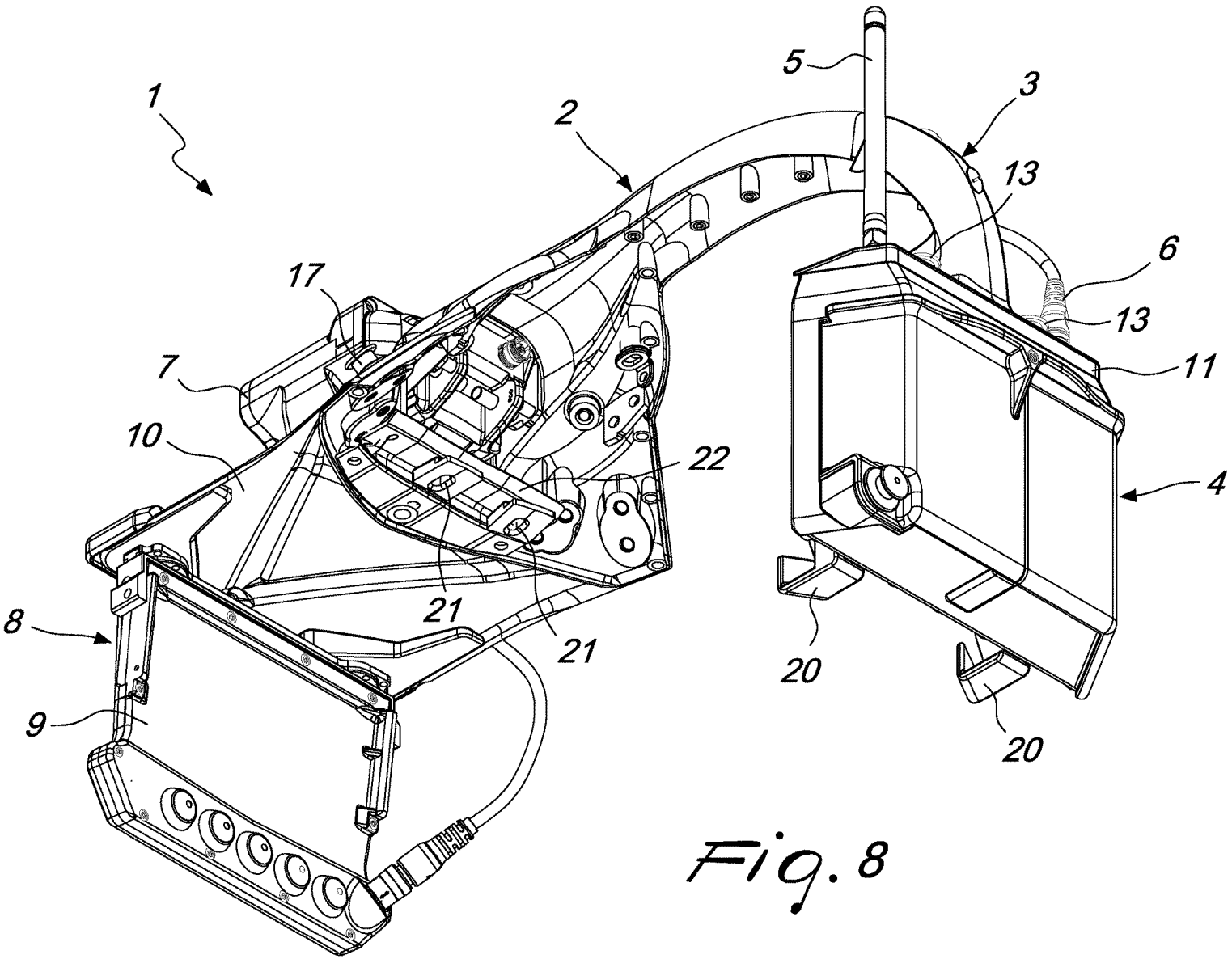
FIG. 8 is an additional perspective view of the vision system according to the present invention.
Figure 9A:
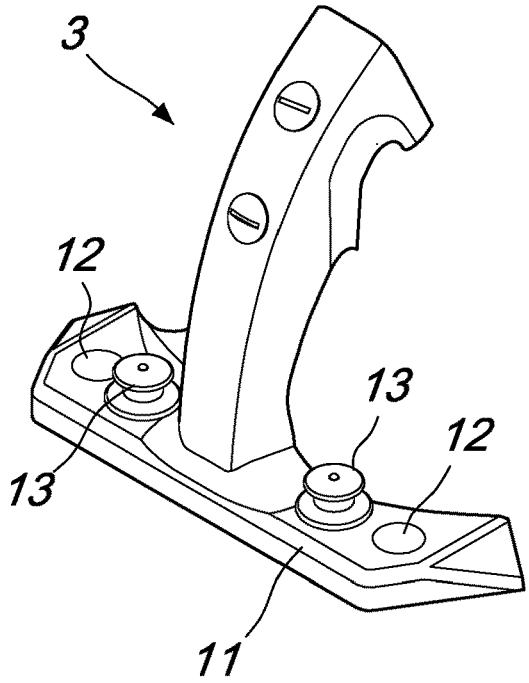
Figure 9B:
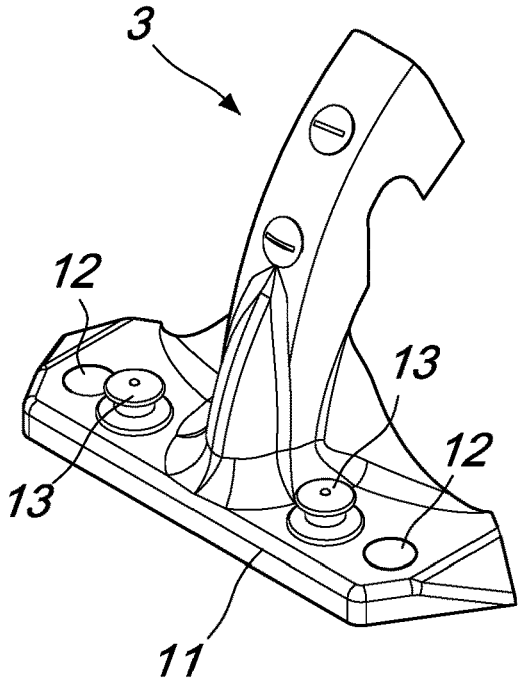
Figure 9C:
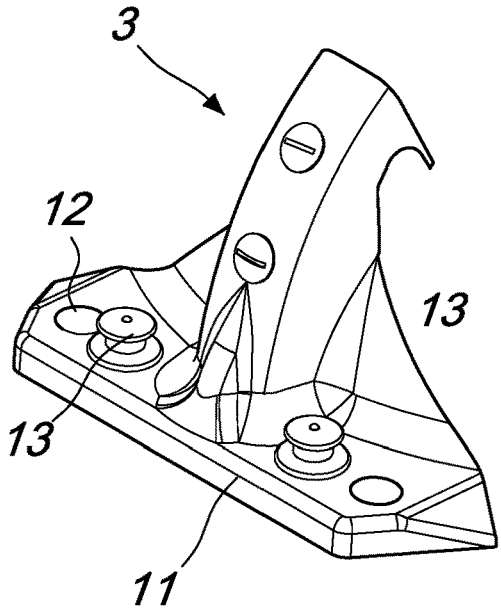
Figure 9D:
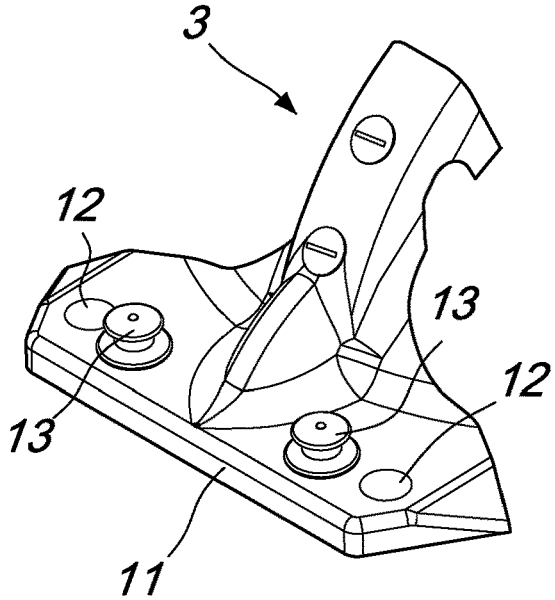
Figure 10:
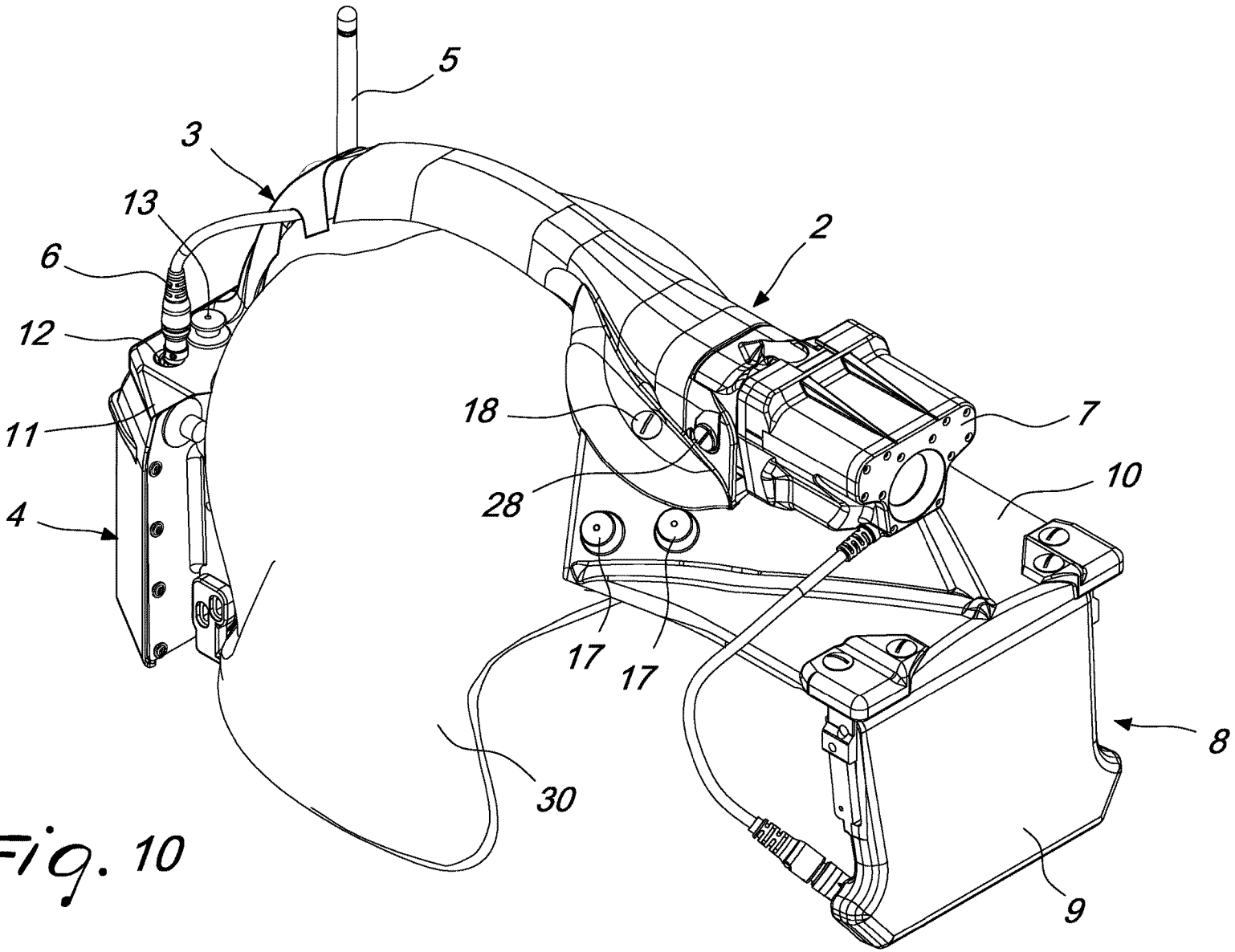

FIGS. 9*a*-9*d* are views of four possible embodiments of a portion of the vision system according to the present invention;

FIG. 10 is a perspective view of the vision system according to the present invention applied to a helmet of a shape which differs from the helmet shown in the previous figures.

With reference to the figures, the modular vision system according to the invention, particularly for helmets and the like, generally designated by the reference numeral 1, comprises a central portion 2 which is connected, by coupling, at a first end thereof with a terminal or rear portion 3 which supports an electronic unit 4 with corresponding antenna 5.

A second end of the central portion 2 is connected, by coupling, to a front portion 8, and a video camera 7 can be coupled to it.

The front portion 8 comprises a visor 10 which is coupled to the central portion 2 and which supports at one of its ends, arranged opposite from the end for mating with the central portion 2, a movable display 9.

Conveniently, the rear portion or rear adapter 3 can have different shapes in order to be adapted to the shape of the helmet (profile of a shell 30 of the helmet), as shown in FIGS. 9*a*-9*d*. Such rear portion 3 comprises a base plate 11 provided with a pair of holes 12 which are adapted to accommodate respectively the antenna 5 and a connector 6, and it also has a pair of quick fixing means 13 which make it possible to fix it to the electronic unit 4.

The central portion 2 is also shaped so as not to interfere with the shape of the helmet (the profile of the shell 30 of the helmet) and, being rigid, it can be adapted to helmets of different shapes in a stable manner. It interlocks in the rear portion or adapter 3 and is connected thereto with a seamless profile, becoming a single body with the rear portion 3.

The central portion 2 ends, at the end that is adapted to be coupled with the front portion 8, in a portion shaped like a widened plate 15 which is provided with a pair of fixing means 16 for each side of the plate, which make it possible to couple the front portion 8, which is constituted by the visor 10 and by the display 9, thereto.

The fixing means 16 are conveniently for example male fixing means, while the front portion 8 has fixing means 17 which are female fixing means.

Conveniently, at the rear portion 3 there are first engagement means which comprise for example a pair of barbs 20 that enable the engagement with the rear edge of the shell 30 of the helmet, while second engagement means which comprise for example another pair of barbs 21 are provided at the central portion 2 of the vision system, at the front plate 15, in order to enable the engagement of the central portion 2 with the front edge of the shell 30 of the helmet and therefore lock the vision system 1 to the shell 30 of the helmet both at the front and at the rear.

Interchangeable adapter profiles 23 are respectively provided at the inner region of the electronic unit 4, in a position adjacent to each barb 20. Such adapter profiles are interchangeable in order to be adapted to the rear profile of each helmet shell.

At the barbs 21 there is furthermore an interchangeable plate 22 which can be changed in order to adapt it to different shapes of helmet.

Conveniently, the central portion 2 is provided with means for connecting the video camera 7, which are for example constituted by a pin 28 that connects the video camera 7 to the central portion and makes it possible to rotate it in order to tilt it upward or downward, by rotating it with respect to the central portion 2 of the vision system which is locked to (together with the portion 3) and integral with the helmet proper.

In substance, therefore, both the rear portion 3 with the electronic unit 4 and the central portion 2 are engaged respectively with the rear edge and with the front edge of the shell 30 of the helmet, thus making the vision system integral with the helmet proper, but without preventing movement of the video camera 7 by tilting it upward or downward, or movement of the display 9 along special guides 26 provided at its region of coupling to the visor 10.

Conveniently, the display 9 can also be angled by rotating it about its vertical axis, with respect to the abovementioned visor 10.

The front portion 8 is engageable with the central portion 2 of the modular vision system using both the engagement means 17 and using screws 18 which are provided at two arm-shaped portions, which are coupled in adapted holes 19 which are provided at the central portion 2, substantially in a position adjacent and lateral to the engagement means of the video camera 7.

Conveniently, the rotation axis of the video camera 7 is perpendicular to the line of vision of the video camera itself.

The coupling between the rear portion 3 and the central portion 2 and the front portion 8 makes it possible to obtain a modular vision system with a seamless profile that is adapted to the shape of the helmet to which it is applied.

The applicability of the vision system 1 to any helmet is ensured by the interchangeability of the portions that constitute it, i.e., the rear portion 3, the front adapter 22, and the rear adapter 23.

By changing at least one of these portions, the vision system according to the invention is made adaptable to any shape of helmet, so that the modular vision system 1 will conform perfectly to the profile of the shell of the helmet, adapting to it and remaining firmly engaged, by way of the barbs 20 and 21, to the rear edge and to the front edge of the shell 30 of the helmet.

The block 25 for tilting the video camera 7 substantially allows an upward tilting of the video camera 7, in that the user may, during use, incline his or her head downward and therefore the video camera 7 will need to be capable of being tilted upward so it can show distinctly and clearly what is happening in front of the user, thus compensating the inclination of the head of the user.

The downward tilt is generally extremely limited, but can be present for particular requirements.

In practice it has been found that the modular vision system according to the invention fully achieves the set aim and objects, since it can be adapted to the shape of any type of helmet, simply by substituting at least one component part thereof without substituting the complex parts of the vision system, such as the electronic unit, the video camera, and the display.

In fact the front portion, and also the video camera and the electronic unit, adapt to any shape of helmet.

Furthermore, the vision system according to the present invention makes it possible to detach the front portion constituted by the visor and the display while keeping all the functionalities of the system active, i.e. vision, parameter detection, wireless transmission, all ensured by the video camera and by the electronic unit. This makes it possible to ensure a documentation of the environments in which the user acts and control thereof remotely.

Conveniently, all the engagement means of the various portions of the vision system are of the rapid type so as not to require tools of any kind.

The simultaneous coupling of the rear portion and of the front portion respectively to the rear edge and to the front edge of the shell of the helmet, as well as to each other, ensures that the vision system is anchored rigidly, stably and non-removably to the shell of the helmet.

The substitution of the portions that make up the vision system does not entail a modification of the enclosures of the electronic parts, i.e. of the video camera, of the electronic unit and of the display.

The video camera, the electronic unit and the display are connected to each other by way of watertight electrical cable connections.

The modular system thus conceived is susceptible of numerous modifications and variations, all of which are within the scope of the appended claims.

Moreover, all the details may be substituted by other, technically equivalent elements.

In practice, the materials used, as well as the contingent shapes and dimensions, may be any according to the requirements and to the state of the art.

The disclosures in Italian Patent Application No. 102020000028895 from which this application claims priority are incorporated herein by reference.

The invention claimed is:

1. A modular vision system for helmets and the like, comprising three portions, a central portion in a single piece, adapted to support a video camera, a rear portion coupled to a first end of the central portion and configured to support an electronic unit, and a front portion coupled to a second end of said central portion, said central portion and said rear portion being configured to conform to a profile of a shell of a helmet, wherein said rear portion is coupled by way of fixing means to said electronic unit, and is provided with first engagement means for engaging a rear edge of the shell of the helmet and with adapters that follow a rear profile of the shell of the helmet.

2. The modular vision system according to claim 1, wherein said central portion is provided at the front with an adapter and with second engagement means which allow engagement with a front edge of the shell of the helmet.

3. The modular vision system according to claim 1, wherein said central portion comprises means for coupling to said video camera, which make it possible to tilt the video camera upward and/or downward.

4. The modular vision system according to claim 1, wherein said front portion comprises a visor adapted to be engaged by way of fixing means with a front plate of said central portion, and a display engaged with said visor.

5. The modular vision system according to claim 4, wherein said front portion is coupled to said central portion by way of additional fixing means.

6. The modular vision system according to claim 5, wherein said front portion is shaped with a pair of arms that are positioned around the second end of said central portion and to be coupled to said central portion by way of said additional fixing means.

7. The modular vision system according to claim 4, wherein said display is orientable with respect to said visor.

8. The modular vision system according to claim 4, wherein said display is connected to said electronic unit and to the video camera by way of a cable.

9. The modular vision system according to claim 1, wherein said rear portion and said central portion are configured to be mutually coupled seamlessly, in order to conform to the profile of the shell of said helmet.

10. A modular vision system for helmets and the like, comprising three portions, a central portion in a single piece, adapted to support a video camera, a rear portion coupled to a first end of the central portion and configured to support an electronic unit, and a front portion coupled to a second end of said central portion, said central portion and said rear portion being configured to conform to a profile of a shell of a helmet, wherein said central portion is provided at the front with an adapter and with second engagement means which allow engagement with a front edge of the shell of the helmet.

11. A modular vision system for helmets and the like, comprising three portions, a central portion in a single piece, adapted to support a video camera, a rear portion coupled to a first end of the central portion and configured to support an electronic unit, and a front portion coupled to a second end of said central portion, said central portion and said rear portion being configured to conform to a profile of a shell of a helmet, wherein said front portion comprises a visor adapted to be engaged by way of fixing means with a front plate of said central portion, and a display engaged with said visor.

* * * * *